United States Patent [19]

Stern et al.

[11] 4,163,639

[45] Aug. 7, 1979

[54] SNOWBALL MAKER

[76] Inventors: Robert G. Stern, 8 Sylvia Rd., North Reading, Mass. 01864; W. Thomas Wallace, 82 Louise Rd., Chestnut Hill, Mass. 02167

[21] Appl. No.: 861,618

[22] Filed: Dec. 19, 1977

[51] Int. Cl.[2] ..... F25C 1/10; B28B 3/00

[52] U.S. Cl. ..... 425/318; 249/161

[58] Field of Search ..... 425/318, DIG. 57, 276, 425/278, 281; 249/55, 118, 160, 161, 162

[56] References Cited

U.S. PATENT DOCUMENTS

| | | | |
|---|---|---|---|
| 436,818 | 9/1890 | Wiatt et al. | 425/318 |
| 604,436 | 5/1898 | Swartz | 425/318 |
| 1,323,582 | 12/1919 | Dow | 425/318 X |
| 3,289,246 | 12/1966 | Deye | 425/318 X |
| 3,836,308 | 9/1974 | Upright | 425/318 |
| 3,995,826 | 12/1976 | Saunders | 425/318 X |

*Primary Examiner*—Richard B. Lazarus
*Assistant Examiner*—John S. Brown
*Attorney, Agent, or Firm*—Kenway & Jenney

[57] ABSTRACT

A snowball maker has opposed inner and outer cup-like shells which interfit to compact snow into a ball. The inner shell deforms, within outer shell, upon full insertion substantially to encircle the snow within the two shells. Upon separating the shells, the inner shell resiliently opens to its original shape for ready release of the compacted ball of snow.

11 Claims, 3 Drawing Figures

FIG. 1
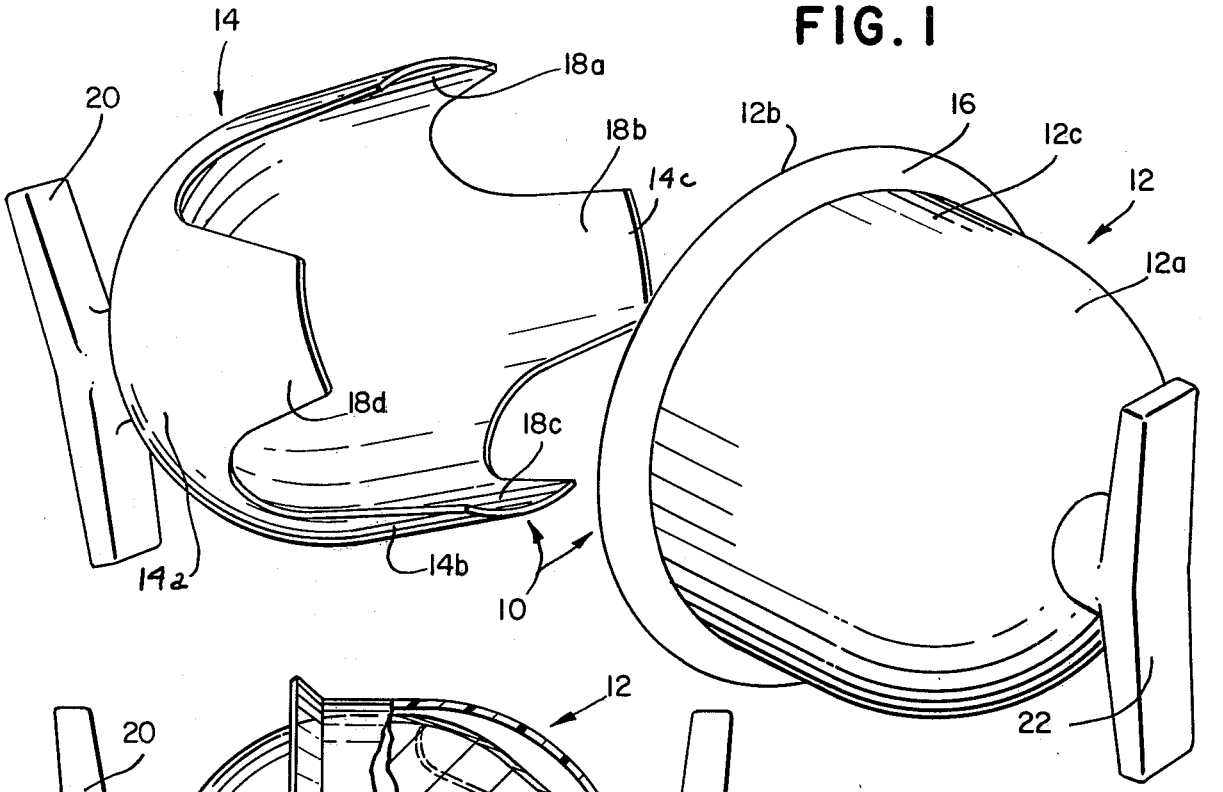
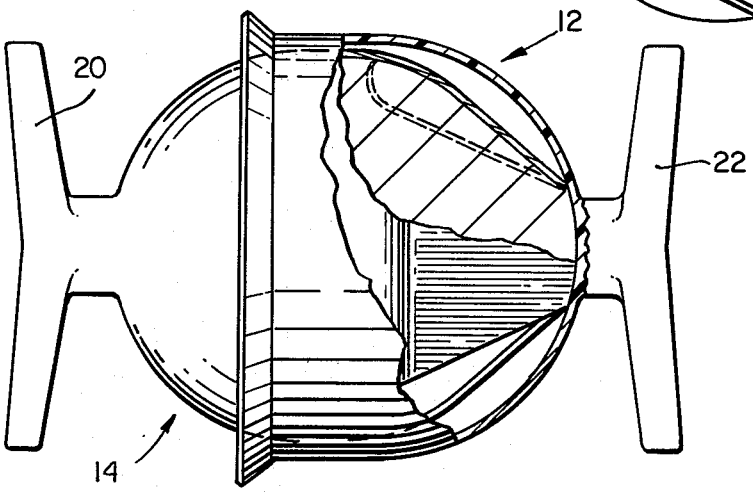
FIG. 2
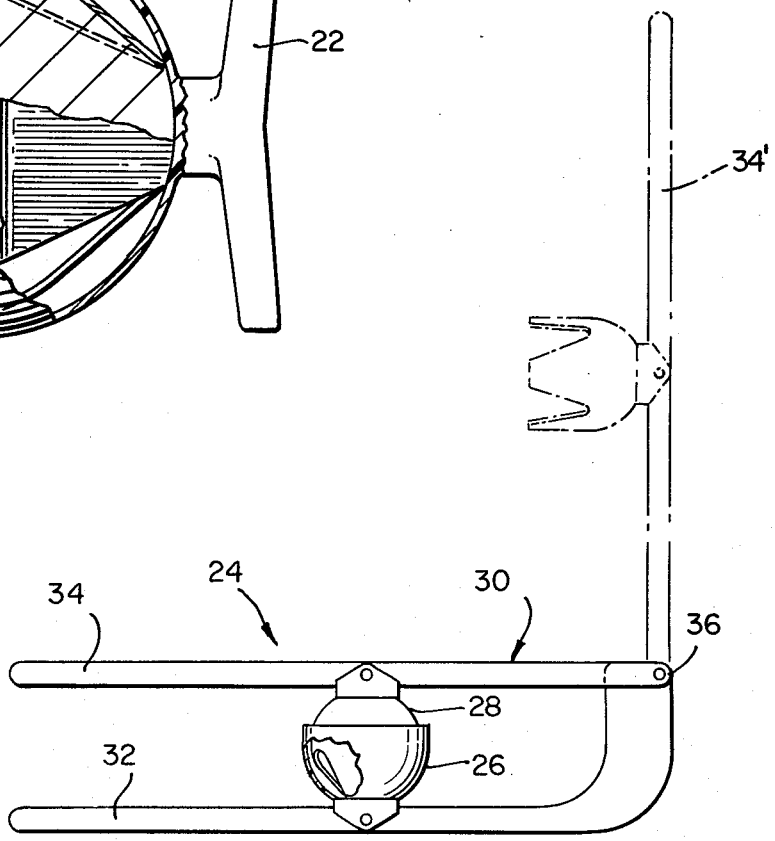
FIG. 3

SNOWBALL MAKER

BACKGROUND OF THE INVENTION

This invention relates to an improved snowball maker. In the prior art of such articles, U.S. Pat. No. 3,836,308 discloses a snowball maker having two opposed semi-spherical shells that interfit to form snow engaged between them into a ball. The shells interfit for a limited and relatively small distance and hence provide only limited compression of snow. The amusement device of U.S. Pat. No. 3,289,246 has a pair of opposed brick-shaped molds that are brought into face-to-face abutment, and hence also provides only limited compression of the snow, sand or other material within the molds. It is also known to provide a device for molding popcorn balls as disclosed in U.S. Pat. No. 436,818, and to provide an ice cream disher in accordance with U.S. Pat. No. 1,323,582. Neither of these devices, however, provides significant compaction of the material engaged between the shells which each employs.

Accordingly, it is an object of this invention to provide a snowball maker which provides significant compression of snow and hence which can form a well-compacted ball of snow.

It is also an object of this invention to provide a snowball maker which forms the ball in a specified one of two interfitting shells. The attainment of this object minimizes the likelihood that a snowball will stick to both shells so as to break apart upon separating the shells. Instead, each snow ball remains whole.

Other objects of the invention are to provide a snowball maker suited for low-cost manufacture, which is easy and is safe to use, and from which a finished snowball can readily be removed.

Other objects of the invention will in part be obvious and will in part appear hereinafter.

SUMMARY OF THE INVENTION

A snowball maker according to the invention has a cup-like inner shell that fits within an outer shell. The inner shell has a rim portion with a normally non-constricted configuration, i.e. the diameter of the shell increases from the closed bottom end and does not decrease upon progression to the peripheral edge. Hence the inner diameter of the inner shell remains at least undiminished as one progresses from the closed bottom end to the peripheral rim.

Upon full insertion of the inner shell within the outer shell, the inner-shell rim portion bears against the outer shell and deforms inwardly, to enclose the snow compacted within the two shells. The snowball is hence formed within the inner shell. Upon separation of the shells, the inner shell opens to its normal configuration and the snowball readily dislodges from the inner shell.

In the illustrated embodiment, the rim portion of the inner shell is slotted to form a circumferential succession of axially-extending fingers. Upon full insertion of the inner shell within the outer shell, the outer shell deflects the fingers inwardly, and they encircle the mass of snow. The slots preferably are sufficiently wide and contoured to allow the fingers to encircle the snowball fully, without the several fingers coming into interfering engagement. Thus, in a preferred embodiment, upon full insertion of the inner shell within the outer shell, the fingers of the inner shell rim portion deform at most into abutting engagement, without interference or overlap.

In one form of the snowball maker, the shells are separate and each has its onw handle. A flared funnel-like skirt is preferably provided on the rim of the outer shell to receive the inner shell and guide it into the outer shell. Alternatively, the two shells can be mounted on a jointed handle structure of the type found on a pair of tongs or like implement.

The invention accordingly comprises an article of manufacture possessing the features, properties and relation of elements exemplified in the articles hereinafter described, and the scope of the invention is indicated in the claims.

For a fuller understanding of the nature and objects of the invention, reference should be had to the following detailed description and the accompanying drawings, in which:

FIG. 1 is a perspective view of a snowball maker with the shells in disengagement;

FIG. 2 is a side elevation view, partly broken away, of the snowball maker of FIG. 1 with the two shells fully interfitted; and FIG. 3 shows another embodiment of the invention.

DESCRIPTION OF THE ILLUSTRATED EMBODIMENT

A snowball maker 10 according to the invention, as FIGS. 1 and 2 show, has a cup-like outer shell 12 that receives an opposed cup-like inner shell 14. Upon pressing the two shells together, the inner shell deforms within the outer shell to gather and to compact the snow contained within the shells. Each shell 12, 14 has a hemispherical base portion **12*a*, 14*a*, and tubular skirt portion 12*b*, 14*b*. The construction of each shell is such that its inner diameter increases with progression from the closed bottom end at the base portion to the skirt portion, and at least is undiminished as one progresses along the skirt portion to the peripheral rim. The point is that the inner diameter of each shell, in its normal configuration of FIG. 1**, does not decrease as one progresses from the closed end to the peripheral rim. Each illustrated shell has a unitary construction, i.e. is a single unitary structure, typically formed by vacuum forming a sheet of synthetic plastic material over a form or by molding or other conventional manufacture.

As FIGS. 1 and 2 also show, the illustrated outer shell 12 is a continuous and unbroken structure, as contrasted with the slotted structure of the inner shell 14 as discussed below. The outer shell 12 accordingly has a continuous unbroken peripheral rim **12*c*. With this structure, the circumference of the outer shell is fixed and in particular it resists enlargement when the inner shell is pressed into it. Further, the illustrated outer shell 12 is flanged adjacent the peripheral rim with a guide funnel 16**.

The inner shell 14 is dimensioned to fit telescopically within the outer shell 12 with an ample clearance fit for convenient insertion, as FIG. 2 shows. The inner shell is axially slotted at the rim **14*c* and through the skirt portion 14*b* to enable the skirt portion to deform radially inward. The slots, of which four are known to define four fingers 18*a*, 18*b*, 18*c* and 18*d* extending along the skirt portion 14*b*, are sufficiently wide and deep so that the fingers can close within the outer shell and not interfere with one another. That is, the fingers do not overlap but only abut one another when fully closed, as in FIG. 2. The illustrated fingers 18** thus form circumferentially-spaced sections of the inner-shell skirt portion, and these sections are resiliently inwardly deflectable.

Each shell 12, 14 preferably has a handle 20, 22 respectively, to facilitate manual manipulation of the shell. The illustrated handles are structurally separate from the shells and are fastened to the axial bottom ends of the shell base portions.

The material for the snowball maker shells is selected for safety in use, ease in manufacturing, non-adherence to snow so that a snowball readily releases from the snowball maker, and for resiliently stiff deflection of the inner shell skirt portion **14*b*** to provide the operation detailed below. Suitable materials are synthetic plastics such as high density polystyrene and others known in the trade.

In typical use of the snowball maker 10, the user scoops each shell 12 and 14 full of snow, and then interfits the inner shell within the outer shell. As FIG. 2 shows, the inner shell 14 fits deeply within the outer shell. However, as the axially-projecting fingers of the inner shell engage the spherically-rounded wall of the outer shell base portion **12*a***, they resiliently deflect inward, following the contour of the outer shell. The slotted skirt portion of the inner shell progressively collapses in this manner about the snow within the shells.

The user can press the two shells together part way, or fully until the inner shell bottoms within the outer shell as in FIG. 2, depending on the compactability of the snow and on the user. Upon full interfitting of the two shells, the inner shell fingers deform toward abutment with one another, substantially to encircle and enclose the snow which was within the outer shell and thereby to form the snow into a ball contained essentially entirely within the inner shell. It will be understood that the fingers, upon pressing the shells together, scrape along the hemispherical walls of the outer shell and thereby gather into the inner shell substantially all the snow within the outer shell.

When the inner shell 14 is withdrawn from the outer shell 12, the compacted snow is within the inner shell 14. The compacted snow has little if any tendency to stick to the outer shell and hence the mass of snow tends to remain in a single unbroken ball fully contained within the inner shell. As soon as the inner shell is separated from the outer shell, the slotted skirt portion resiliently returns to its normal open, large-diameter shape (FIG. 1), and the ball of snow is readily removed. The resultant snowball is generally highly compacted due to the relatively high ratio of the combined volume of the two shells prior to being fitted together to the volume of the inner shell when fully nested within the outer shell. The attainment of a high ratio of compression, coupled with substantial containment of the snow mass within one of the mating shells, are features of the unique structure of the invention. FIG. 3 shows another snowball maker 24 which employs interfitting shells 26 and 28 similar to the shells 12 and 14 of the snowmaker 10, but mounted on a hinged handle structure 30 instead of being separate as in FIG. 1. The outer shell 26 and the inner shell 28 can be identical to the shells 12 and 14 of FIG. 1 respectively, except that the outer shell 26 typically does not require a flared guide funnel like the funnel 16 of FIG. 1. Further, a mounting fixture **26*a*, 28*a* projects outwardly from the bottom of the base portion of each shell for mounting that shell on the handle structure 30. Each shell preferably is free for at least limited pivoting movement on the handle structure 30** to facilitate full interfitting of the shells.

The illustrated handle structure 30 has two handle arms 32 and 34 pivotally joined together with a pin 36 at one end and manually-engageable at their other ends. The handle arms extend alongside one another from the pivot pin 36 when in the closed position shown in full lines, and each carries one shell 26, 28 disposed in opposed facing relation to the other shell. The shells are mounted along the handle arms spaced from the pivot pin 36 by a distance which provides the desired mechanical advantage for bringing the shells into full engagement.

The handled snowball maker 24 is easy to use, for one simply opens the handles, as illustrated by the position of the handle arm 34' shown with broken lines relative to the other handle arm 32, to separate the shells. Snow is scooped into the two shells and the handles are moved to the closed position shown in solid lines, which brings the two shells into interfitted engagement as described above with reference to FIG. 2 for the snowmaker 10. This motion compacts the gathered snow principally within the inner shell 28. Upon opening the handles, the compacted snowball is retrieved from the inner shell 28.

In the specific handle structure 30 illustrated, one handle arm 34 is straight, and the other handle arm 32 has a J-like contour to bring the two handle arms together at the location of the pivot pin 36 and maintain the other ends of the handle arms spaced apart for easy manual engagement. In particular whereas the illustrated handle structure disposes the shells between the pivot pin and the manually-engageable ends of the handle arms, the alternative where the shells are at the ends of the handle arms, and the pivot is intermediate, can also be used. Other configurations of handle arms 32 and 34 will be apparent to those skilled in the art and can be used, as will other configurations of a handle structure having two pivotally-joined arms, each of which carries one of the two snowmaker shells. A single pair of handle arms can, as an alternative, be fitted with several pairs of interfitting shells; with this arrangement one can form two or more snowballs at a time.

It will thus be seen that the invention provides a construction for a snowball maker capable of forming the ball in one of two interfitting shells. The articles efficiently attain the objects set forth above, among those made apparent from the preceding description. Since certain changes may be made in the above articles without departing from the scope of the invention, it is intended that all matter contained in the above description or shown in the accompanying drawings be interpreted as illustrative and not in a limiting sense. Illustrative of such changes is that the fingers of the inner shell can be tapered in thickness, as well as in width, to enhance bending substantially continuously along their lengths upon being nested within the outer shell. Also, each shell can have a handle molded on it as an integral part. A further illustrative modification is to design the article as a caricature or other fanciful representation such as of an animal. For example, each shell, and especially the outer shell and the handle and the base portion of the inner shell, may be styled to have an animal-like appearance.

It is also to be understood that the following claims are intended to cover all of the generic and specific features of the invention herein described, and all statements of the scope of the invention which, as a matter of language, might be said to fall therebetween.

Having described the invention, what is claimed as new and secured by Letters Patent is:

1. A snowball maker comprising an outer shell and an inner shell, said shells being cup-like and being adapted to interfit in opposition with one another for compacting snow therein into a unitary mass, said inner shell having a hemispherical base portion conjoined and coaxial with a peripheral portion normally of tubular configuration and having an inner diameter which is non-diminishing upon progression from the closed end of the shell to the rim, and said inner shell peripheral portion having a plurality of circumferentially-spaced sections, said peripheral portion spaced sections being resiliently deformable radially inwardly to a closed abutting configuration upon telescopic interfitting of said peripheral portion within said outer shell for substantially encircling the snow within the two shells, said peripheral portion resiliently resuming said normal configuration thereof upon removal of the inner shell from the outer shell.

2. A snowball maker according to claim 1 in which said outer shell comprises a body portion into which said inner shell fits and which has substantially fixed circumferential dimensions.

3. A snowball maker comprising an outer shell and an inner shell, said shells being cup-like and oppositely interfitting with one another to diminish the volume therebetween for compacting snow therein, said outer shell having a base portion for increasingly deforming said inner shell radially inwardly upon progressive interfitting therein, said inner shell having a rounded base portion and a peripheral portion, said peripheral portion being normally of open tubular configuration with substantially undiminished diameter upon progression therethrough from said base portion, and having circumferentially-spaced sections thereof which are resiliently inwardly deformable to a closed abutting configuration upon telescopic interfitting engagement thereof within said outer shell, said inner shell peripheral portion automatically resiliently resuming said normal open configuration thereof upon withdrawal and disengagement from said outer shell.

4. A snowball maker according to claim 3

A. in which said inner shell peripheral portion is cylindrical in said open configuration, and B. in which said inner shell has a hemispherical base portion conjoined and coaxial with said peripheral portion.

5. A snowball maker according to claim 3 in which said outer shell includes an outwardly-flared flanged portion forming the rim thereof for guiding said inner shell into interfitting relation with said outer shell.

6. A snowball maker according to claim 3 in which said inner shell peripheral portion is axially slotted for providing said peripheral portion with resiliently-deformable fingers.

7. A snowball maker according to claim 6 in which said outer shell comprises a base portion for guidingly camming said inner shell fingers radially inward upon interfitting of said shells together.

8. A snowball maker according to claim 3, further comprising handle means on said shells for facilitating manual manipulation of said shells.

9. A snowball maker according to claim 8 in which said handle means comprises separate handles on said outer shell and on said inner shell.

10. A snowball maker according to claim 8 having at least one pair of inner and outer shells, and in which said handle means comprises a pair of first and second pivotally joined handles, each of which mountingly carries at least one said shell, said handles being movable relative to one another for interfitting said shells and alternatively for removably disengaging said shells from one another.

11. A snowball maker comprising

A. an outer shell having a cup-like base portion and arranged for telescopically receiving therein and radially inwardly camming an interfitting resiliently-deformable inner shell, and B. an inner shell having a cup-like base portion and a resilient peripheral portion axially extending therefrom, said resilient portion normally having an open configuration with a diameter at least as large as the largest diameter in said cup portion, and nestably fitting telescopically within said outer shell, C. said peripheral portion having a circumferential succession of axially-extending fingers circumferentially spaced apart, said fingers being resiliently radially inwardly deformable upon camming engagement within said outer shell cup portion and abutting one another upon being telescopically deposed fully within said outer shell.

* * * * *